United States Patent [19]

Hanna et al.

[11] Patent Number: 4,984,687

[45] Date of Patent: Jan. 15, 1991

[54] TOOLBOX WITH PEAKED ROOF

[75] Inventors: Thomas E. Hanna; Keith E. Brightbill, both of Wooster, Ohio

[73] Assignee: Rubbermaid Incorporated, Wooster, Ohio

[21] Appl. No.: 471,925

[22] Filed: Jan. 26, 1990

[51] Int. Cl.[5] ..... B65D 85/28

[52] U.S. Cl. ..... 206/373; 312/DIG. 33; 220/522

[58] Field of Search ..... 206/372, 373, 374, 234, 206/235; 312/DIG. 33; 220/23, 521, 522

[56] References Cited

U.S. PATENT DOCUMENTS

| | | | |
|---|---|---|---|
| D. 158,368 | 5/1950 | Felts et al. | D58/12.6 |
| D. 161,866 | 2/1951 | Peterson | D31/4 |
| D. 237,121 | 10/1975 | Metzner | D87/1 |
| 1,147,086 | 7/1915 | Greenway | 220/23 |
| 1,748,841 | 2/1930 | Hermani | 220/23 |
| 1,882,756 | 10/1932 | Boynton | 312/DIG. 33 |
| 2,299,375 | 10/1942 | Bruske | 220/23 X |
| 2,504,879 | 4/1950 | Reeves | 312/DIG. 33 |
| 2,572,706 | 10/1951 | Eichholz et al. | 220/23 X |
| 2,672,232 | 3/1954 | Kessell, Jr. | 220/23 X |
| 2,673,783 | 3/1954 | Rahm et al. | 220/23 X |
| 2,948,080 | 8/1960 | Hawley | 43/54.5 |
| 3,317,097 | 5/1967 | Giordano | 220/23 X |
| 3,578,153 | 5/1971 | Olson | 220/23 X |
| 3,831,805 | 8/1974 | Yonce | 312/DIG. 33 X |
| 4,150,746 | 4/1979 | Buglione | 206/372 |
| 4,619,363 | 10/1986 | Wolfseder | 206/373 |
| 4,659,154 | 4/1987 | Jenkins | 312/290 |
| 4,840,273 | 6/1989 | Zavacki | 220/23 X |
| 4,846,346 | 7/1989 | Kime | 206/372 |

OTHER PUBLICATIONS

Plano catalog, 1989, Plano Molding Company, 431 E. South Street, P.O. Box 189, Plano, Ill. 60545-0189.

Flambeau catalog, 1989, Flambeau Products Corporation, Hardware Division, 15981 Valplast Rd., Middlefield, Ohio 44062.

Contico catalog, 1989, Contico, St. Louis, Mo. 63132.

Disston brochure, 1989, The Disston Company, P.O. Box 3000, Danville, Va. 24543.

MTM Tool Gard brochure, MTM Molded Products Company, P.O. Box 14117, Dayton, Ohio 45414.

GSC brochure, GSC Technology Corporation, Champlain, N.Y.

Ekco catalog, 1989, Ekco Specialty Products, 165 W. Chicago Avenue, Chicago, Ill. 60610.

*Primary Examiner*—Paul T. Sewell

*Assistant Examiner*—Jacob K. Ackun, Jr.

*Attorney, Agent, or Firm*—Renner, Kenner, Greive, Bobak, Taylor & Weber

[57] ABSTRACT

A toolbox (10) includes a base (11) for containing materials and a cover (15) attached by hinges (16) to the base (11). The cover (15) includes sidewalls (20, 21) which extend upwardly from the base (11) and are joined near the top thereof by a curvilinear portion (22). At least one closure member (36) extends between the sidewalls (20, 21) below the curvilinear portion (22) to define with the sidewalls (20, 21) and the curvilinear portion (22) at least one compartment (35) within the cover (15).

8 Claims, 2 Drawing Sheets

TOOLBOX WITH PEAKED ROOF

TECHNICAL FIELD

This invention relates to a utility box such as a box for holding and storing tools or the like. More particularly, this invention relates to a box which has a peaked, as opposed to flat, cover or roof. More specifically, this invention relates to a box with a peaked roof which advantageously utilizes the space within the peaked roof for storing articles therein.

BACKGROUND ART

Most utility boxes for the storage of tools or the like are configured in the shape of a generally rectangular container with a cover or roof hingedly attached thereto. Generally, the top is flat or planar with a relatively low profile and as such, they can be conveniently stacked and stored as desired. However, where stacking is not necessary, a more aesthetically appearing cover can be created without such a low, planar profile which also provides the utility box with more containing capacity, that is, materials can be stacked in the box and extend upwardly into the configured lid. However, even then all of the space within the lid cannot be conveniently utilized without the fear that the contents would spill out of the box upon opening.

Thus, to date, there are no aesthetically pleasing, nonplanar top profile utility boxes which can totally take advantage of the additional space afforded by the nonplanar profile configuration of the cover.

DISCLOSURE OF THE INVENTION

It is thus the primary object of the present invention to provide a utility box, such as a toolbox, with an aesthetically pleasing nonplanar cover while taking full advantage of the additional storage space provided by such a cover.

It is another object of the present invention to provide a toolbox, as above, which has at least one useful storage compartment in the top of the cover thereof.

It is a further object of the present invention to provide a toolbox, as above, in which the top of the cover is curvilinear in nature providing a bottom for the storage compartment from which items stored therein can be easily retrieved.

These and other objects of the present invention, as well as the advantages thereof over existing prior art forms, which will become apparent from the description to follow, are accomplished by the means hereinafter described and claimed.

In general, a box for holding tools or the like includes a base for containing the tools and a cover hingedly attached to the base. The cover includes a plurality of sidewalls extending upwardly from the base when the cover is closed on the base. The cover also includes a curvilinear portion spanning between the sidewalls and forming the top of the cover. A closure member extends from the sidewalls below the curvilinear portion of the cover to form at least one compartment within the cover for containing materials therein.

A preferred exemplary toolbox incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
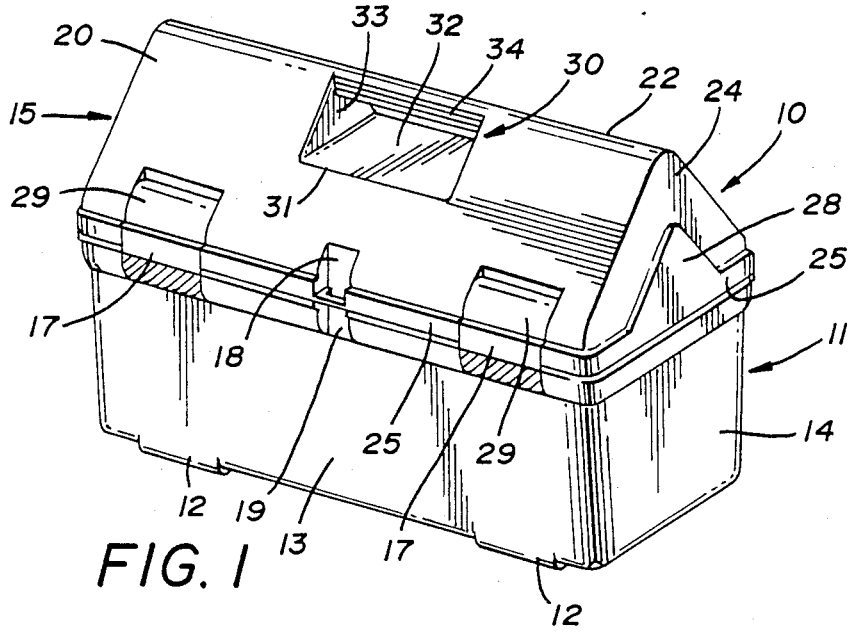
FIG. 1 is a perspective view of a toolbox according to the concept of the present invention with the cover closed on the base.

A toolbox according to the concept of the present invention is indicated generally by the numeral 10 in FIG. 1. Toolbox 10 includes a conventional base portion, generally indicated by the numeral 11, which rests on feet 12 and includes front and rear walls 13 and sidewalls 14 thereby forming a box-like structure to contain tools or the like.

A cover portion, generally indicated by the numeral 15, is hingedly attached, as at 16 (FIG. 2), to base portion 11. Cover 15 is maintained in a closed position on base 11 by means of hinged latches 17, and cover 15 and base 11 can be provided with complementary lock receiving areas, 18 and 19 respectively, to receive a conventional lock so that toolbox 10 can be secured.

The details of such elements as, for example, base portion 11, hinge 16, latches 17 and lock receiving areas 18 and 19 are not important to the present invention. Thus, these elements could take on any conventional configuration without departing from the spirit of this invention which lies in the unique cover portion 15 now to be described in detail.

Cover portion 15 includes a front sidewall 20 and a rear sidewall 21 extending angularly upwardly from base portion 11 thereby converging toward each other at the top of toolbox 10, where they are joined by a curvilinear peak portion 22. Cover 15 also includes generally vertical end walls 23 and 24. Sidewalls 20 and 21 as well as end walls 23 and 24 are all provided with a lip 25 at their lower ends which is adapted to fit over the upper rim 26 (FIG. 2) of base portion 11. To complement the generally triangular appearance of end walls 23 and 24, the lateral extent of lip 25 continues upwardly on end walls 23 and 24 forming generally triangular embellishments 27 and 28, respectively.

In addition to having the recessed lock receiving area 18, the lower end of sloping front wall 20 is provided with two recesses 29 to be engaged by latches 17 in a conventional manner. The lower end of sloping rear wall 21 forms a portion of the conventional hinge construction 16.

Cover portion 15 is also provided with a recessed handle area indicated generally by the numeral 30. Handle area 30 is formed by rectangular apertures 31 formed in walls 20 and 21 thereby establishing a grip area having a horizontal base 32 and generally triangular sidewalls 33. The curvilinear peak portion 22 is, however, uninterrupted at handle area 30 thereby forming a grip member 34.

Figure 3:
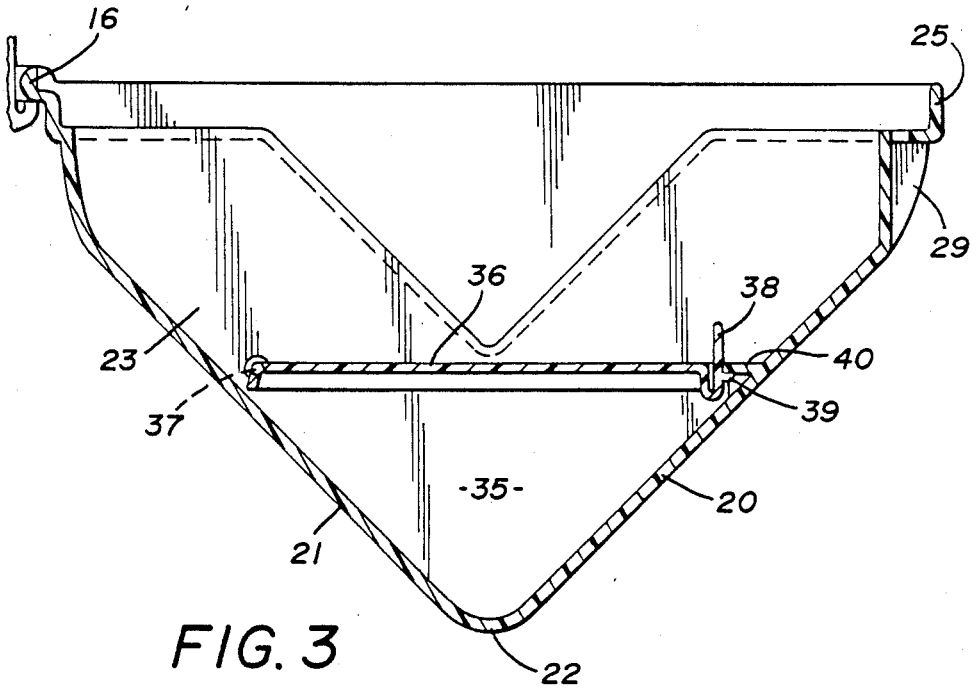
FIG. 3 is a sectional view taken substantially along line 3—3 of FIG. 2.
Figure 2:
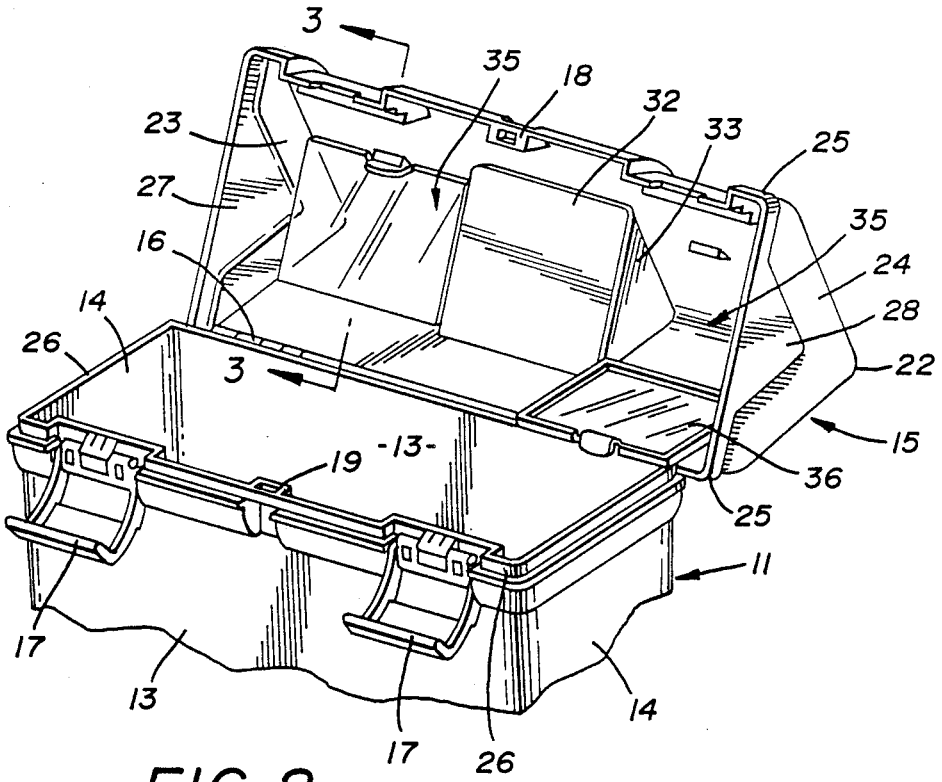
FIG. 2 is a fragmented perspective view of the toolbox of FIG. 1 with the cover partially swung open away from the base.

The area under cover portion 15 within toolbox 10 is best shown in FIGS. 2 and 3. Because of the generally peaked, as opposed to flat, nature of cover portion 15, toolbox 10 can, of course, hold more items than could be held merely within the confines of base portion 11.

Thus, items stored in toolbox 10 can extend upwardly within cover portion 15 to some extent without being spilled from toolbox 10 when it is opened.

In order to take advantage of all available space, compartments, generally indicated by the numeral 35, are provided at the top of cover portion 15. Each compartment 35 is conveniently formed by means of a closure member 36 having one end which is shown as being hinged, as at 37, in any conventional manner for swinging movement relative to rear cover sidewall 21. The other end of each closure member 36 is provided with a clasp 38 having a barb 39 which can engage a nub 40 formed on the underside of front cover sidewall 20.

Closure members 36, and in particular clasp 38 thereof, are preferably formed of a somewhat flexible plastic material so that clasp 38 can be grasped and flexed so that barb 39 can be disengaged from nub 40. Closure member 36 can then be swung on hinge 37 to open compartment 35, the right hand compartment 35 being shown in the open condition in FIG. 2. Closure members 36 are also preferably made of a clear or transparent plastic material so that the user can readily observe the contents of the compartments 35.

With closure members 36 in the closed position, as shown on the left hand side of FIG. 2, a totally enclosed compartment is formed defined by a portion of sidewalls 20 and 21, curvilinear peak 22, end walls 23 or 24 and sidewalls 33 of recessed handle area 30. When cover 15 is closed on base 11, materials in compartments 35 are confined therein resting on closure members 36. When the cover is opened, as shown in FIG. 2, access to the materials can be gained by opening closure members 36 as previously described. It should be pointed out that FIG. 2 does not show cover 15 totally open but rather at an intermediate open position. In actuality, when cover 15 is totally open, it will have swung 180 degrees on hinges 16 and curvilinear peak 22 will thereby form the bottom of compartments 35. As such, small items such as screws, nails or the like which might be stored in compartments 35 can be easily removed from the compartments, there being no corners or flat surfaces which might entrap such small items or otherwise make them less accessible.

It should also be appreciated that while two compartments 35 are shown and described herein, any number of compartments could be formed within cover 15 without departing from the spirit of this invention. For example, two compartments could readily be formed on each side of recessed handle area 30 or, if a different type of handle were employed not utilizing a recessed handle area, one large compartment extending across the entire width of the toolbox could be formed.

It should thus be evident that the objects of the present invention are accomplished by the toolbox just described thereby substantially improving the art.

What is claimed is:

1. A toolbox or the like comprising a base for containing materials, a cover hingedly attached to said base, said cover including sidewalls extending upwardly from said base when said cover is closed on said base and a curvilinear portion spanning between said sidewalls of said cover and forming the top of said cover, a recessed grip area near the top of said cover, said grip area having sidewalls extending downwardly from the top of said cover, said cover including generally vertical end walls extending upwardly from said base when said cover is closed on said base, and closure means extending from said sidewalls of said cover below said curvilinear portion and defining with said curvilinear portion with said sidewalls and with said end walls a compartment on each side of said recessed grip area within said cover for containing materials therein.

2. A toolbox according to claim 1 wherein said closure means includes a closure member for each said compartment, each said closure member being hingedly swingable relative to a said sidewall of said cover.

3. A toolbox according to claim 2 further comprising nub means on another of said sidewalls an clasp means on each closure member to engage said nub means.

4. A toolbox according to claim 1 wherein each said closure means member is made of a transparent material.

5. A toolbox according to claim 1 wherein said sidewalls of said cover converge toward each other from said base to said curvilinear portion.

6. A toolbox according to claim 1, said base including latch means, one of said sidewalls of said cover including recess means to receive said latch means.

7. A toolbox according to claim 1, said base and one of said sidewalls of said cover including complementary lock receiving areas.

8. A toolbox according to claim 1 further comprising a gripping handle spanning across said grip area, said gripping handle being coincident with said curvilinear portion.

* * * * *

UNITED STATES PATENT AND TRADEMARK OFFICE

CERTIFICATE OF CORRECTION

PATENT NO. : 4,984,687

DATED : January 15, 1991

INVENTOR(S) : Thomas E. Hanna; Keith E. Brightbill

It is certified that error appears in the above-identified patent and that said Letters Patent is hereby corrected as shown below:

Column 4, line 30, claim 3, line 2, "an" should read --and--.

Column 4, line 31, claim 3, line 3, after "each" insert --said--.

Column 4, line 33, claim 4, line 2, delete the word "means".

Signed and Sealed this

Second Day of March, 1993

*Attest:*

STEPHEN G. KUNIN

*Attesting Officer*

*Acting Commissioner of Patents and Trademarks*